US005383246A

United States Patent [19]

Hagen

[11] Patent Number: 5,383,246

[45] Date of Patent: Jan. 24, 1995

[54] SEMI-RIGID SWEEPER COVER

[75] Inventor: Holger Hagen, Pittsburgh, Pa.

[73] Assignee: Pleiger Plastics Company

[21] Appl. No.: 216,675

[22] Filed: Mar. 23, 1994

[51] Int. Cl.[6] ..... E01H 1/04

[52] U.S. Cl. ..... 15/246; 15/83

[58] Field of Search ..... 15/79.1, 79.2, 82–87, 15/246, 340.1, 340.3, 340.4

[56] References Cited

U.S. PATENT DOCUMENTS 3,930,277 1/1976 Wulff ..... 15/83
4,709,436 12/1987 Berfield et al. ..... 15/83
5,249,332 10/1993 Wilkerson ..... 15/83

*Primary Examiner*—Edward L. Roberts
*Attorney, Agent, or Firm*—Titus & McConomy

[57] ABSTRACT

The present invention relates to a semi-rigid sweeper cover for use in mechanical street sweepers and, in particular, to a polymeric cover for rotary sweepers. The semi-rigid sweeper cover is effective to inter-act with and assist a sweeper brush in lifting and guiding swept materials to a storage area. The sweeper cover has an inner surface which conforms to the shape of the sweeper brush when in motion and is comprised of a polymer selected from the group consisting of rubber, ultra-high molecular weight polyethylene, polypropylene, polyurethane, nylon and acrylic with embedded fibers. The use of such polymers greatly extends the useful life of the sweeper cover. The polymeric cover described by the present invention may be used as an inner protective liner for an exterior metal cover. Alternatively, the polymeric cover of this invention may be used, by itself, as a sweeper cover. Metal tubing and stud bolts are attached to the exterior of the cover so as to permit it to interact with and connect to a mechanical street sweeper in the same manner as present sweeper covers operate.

18 Claims, 6 Drawing Sheets

SEMI-RIGID SWEEPER COVER

FIELD OF INVENTION

The present invention relates to a semi-rigid sweeper cover used in mechanical street sweepers and, in particular, to a polymeric cover for rotary sweepers.

BACKGROUND OF THE INVENTION

Mechanical sweepers, especially for roadways, are well known. See, for example, U.S. Pat. Nos. 5,125,128; 4,701,969; 4,602,400; 4,393,537; 3,808,632; 3,535,731 and 3,284,831, as well as commercial units built for example by Elgin Sweeper Company. Typical of this type of mechanical sweeper are cylindrical rotary sweepers mounted at the rear of a vehicle. Such rear-mounted rotary sweepers require a sweeper cover in order to facilitate the movement of swept material upward into the storage area of the sweeping system and also to prevent any swept material from being discharged outward from the mechanical sweeper.

Such sweeper covers are presently constructed of metals including steel, steel alloys or aluminum. The typical lifetime of such metal sweeper covers are 80 to 160 hours. After such period of use, the frictional and corrosive wear caused by the inter-action between the sweeper brush and the sweeper cover causes the metal cover to wear down and become unusable. At this point in time, the sweeper cover must be replaced.

Because of the expense involved in replacing metal sweeper covers, efforts have been undertaken to increase the useful life of such covers. Such attempts have involved flame-treating steel sweeper covers in an attempt to harden the covers and lengthen their useful lives. Such flame-treatment has not resulted in any appreciable benefit, however.

Accordingly, it is the object of the present invention to provide a semi-rigid sweeper cover which is capable of a substantially longer lifetime use than the present metal sweeper covers, in the approximate range of 1,000 hours.

SUMMARY OF THE INVENTION

In accordance with the present invention, a semi-rigid sweeper cover is provided to extend the lifetime use of such covers used in connection with rotary sweepers, and in particular mechanical street sweepers. Such extension of lifetime use is obtained through utilization of a polymer liner or shield.

In one embodiment of this invention, a sheet of polymer is attached to the inside of a metal sweeper cover along its entire length. This attachment can be accomplished by means of an adhesive, mechanical fasteners or a combination of both. Alternatively, the polymer can be applied and simultaneously attached to the metal sweeper cover by means of spraying. A variety of different polymers with a shore hardness in the range of 50° A to 70° D may be selected for this application including rubber, ultra-high molecular weight polyethylene, polypropylene, polyurethane, nylon, or acrylics with embedded fibers.

In a modification of the invention, a polymeric cover with metal tubing and stud bolts embedded into the polymer is provided. These embedded metal parts allow the cover to be installed and operated in the same manner as the metal sweeper covers presently in use. Such metal inserts also provide improved structural integrity.

A further embodiment of the invention provides a polymeric cover with exterior ribs attached thereto to provide structural integrity as well as connection points for tubing and bolts. Such ribs may be fabricated from metal or polymer.

The advantages of the various embodiments of this invention are numerous. Each will outlast metallic covers constructed of steel, hardened steel or aluminum and provide weight savings. Specifically, the variations of the semi-rigid sweeper cover described by this invention have useful lives in the approximate range of 1,000 hours. In addition, rubber or polyethylene covers can be easily returned to their original shape without noticeable damage in the event of a rear impact. Finally, if the polymeric cover embodiments of the invention (without a metal cover) are utilized, there is no need for field installation by customers, such as may be required if the cover liner is employed.

DETAILED DESCRIPTION OF THE PREFERRED EMBODIMENTS

Figure 1:
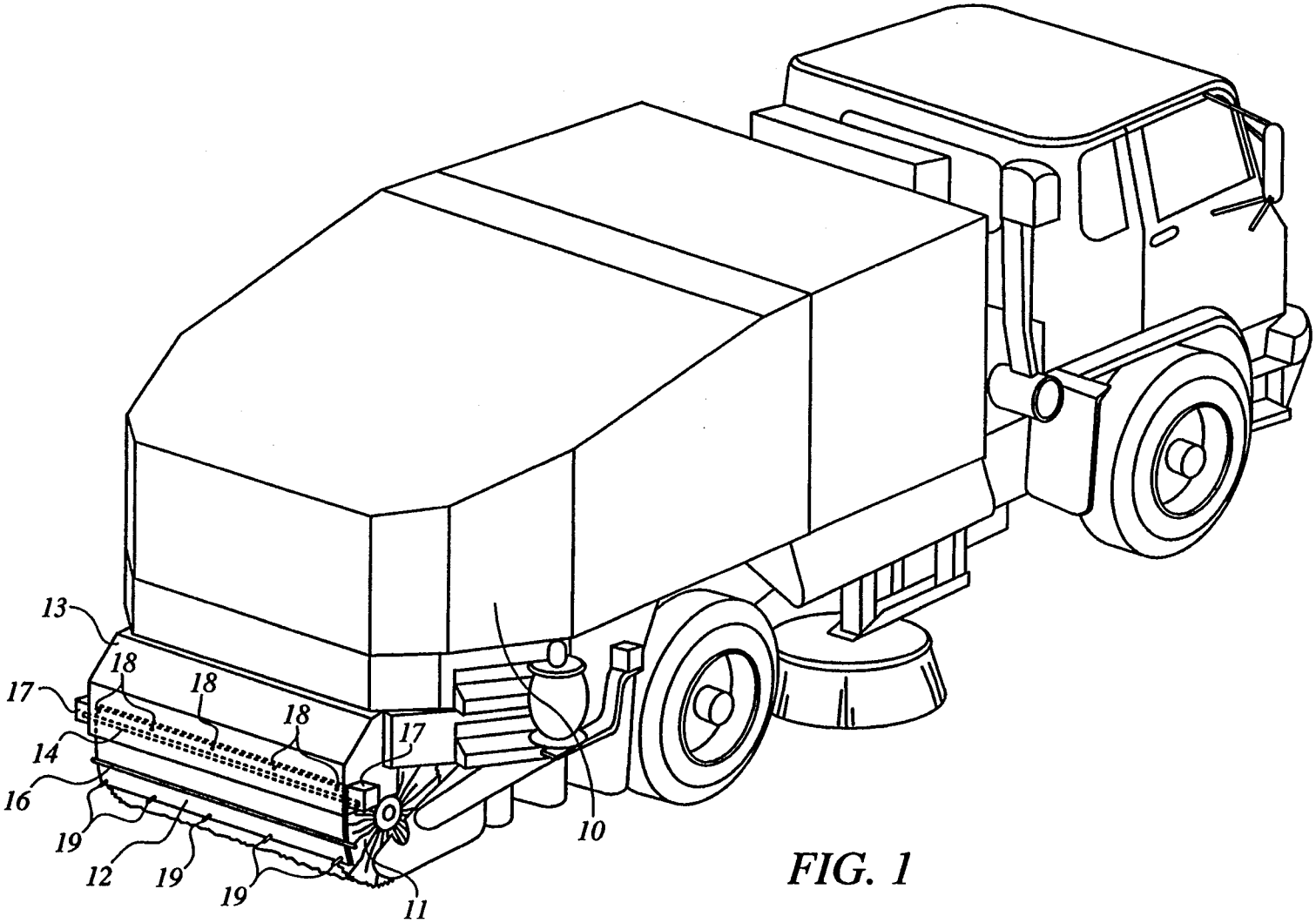
FIG. 1 is an isometric rear view of a mechanical street sweeper with a sweeper cover mounted over a sweeper brush.

FIG. 1 depicts the typical implementation of a sweeper cover 12. In FIG. 1, a cylindrical rotary sweeper brush 11 is mounted on the rear of street sweeper 10. Sweeper cover 12 extends downward from upper cover 13 and conforms to the cylindrical shape of sweeper brush 11.

When mechanical street sweeper 10 is in operation, sweeper brush 11 rotates in a clockwise direction, causing swept materials to be gathered against and lifted upward by sweeper cover 12. Swept materials are then directed into a storage area within mechanical street sweeper 10.

Sweeper cover 12 has tubes 14 and 16 attached to its exterior. Tubes 14 and 16 are typically comprised of metals such as steel, steel alloys or aluminum and are attached by means of soldering to sweeper cover 12. Tube 14 is movably attached to upper cover 13 such that tube 14 provides an axis of rotation for sweeper cover 12. Such moveable attachment of sweeper cover 12 to upper cover 13 may be accomplished by means of mounts 17 which receive and provide support to the ends of tube 14. Other means of moveable attachment are possible. Sweeper cover 12, as a result of said movable attachment, can be lifted upward in order to aid in any servicing of sweeper brush 11 or the interior of sweeper cover 12. Tube 16 protects sweeper cover 12 against rear-end collisions and also provides a means of attachment so that sweeper cover 12 can be secured when it is lifted upward.

Upper bolts 18 are located on the exterior, upper edge of sweeper cover 12 and are used to attach a fabric-laminated piece of rubber to the upper end of sweeper cover 12. This fabric-laminated piece of rubber, in turn, also attaches to the interior of upper cover 13 and provides a covering between the area of attachment between upper cover 13 and sweeper cover 12. Preferably, five (5) upper bolts 18 are provided, although other numbers and arrangements of such bolts are possible.

Lower bolts 19 are attached to the exterior, lower edge of sweeper cover 12 and are used to attach additional covers to the lower edge of sweeper cover 12. Sweeper cover 12 preferably is positioned five to six inches above the road surface. If additional covering is desired between the end of sweeper cover 12 and the road surface, lower bolts 19 provide the means for attaching such additional cover to sweeper cover 12. This lower cover can be comprised of metals, polymers or both. As with upper bolts 18, while five (5) lower bolts 19 are shown in linear fashion, other numbers and arrangements may be used.

Figure 2:
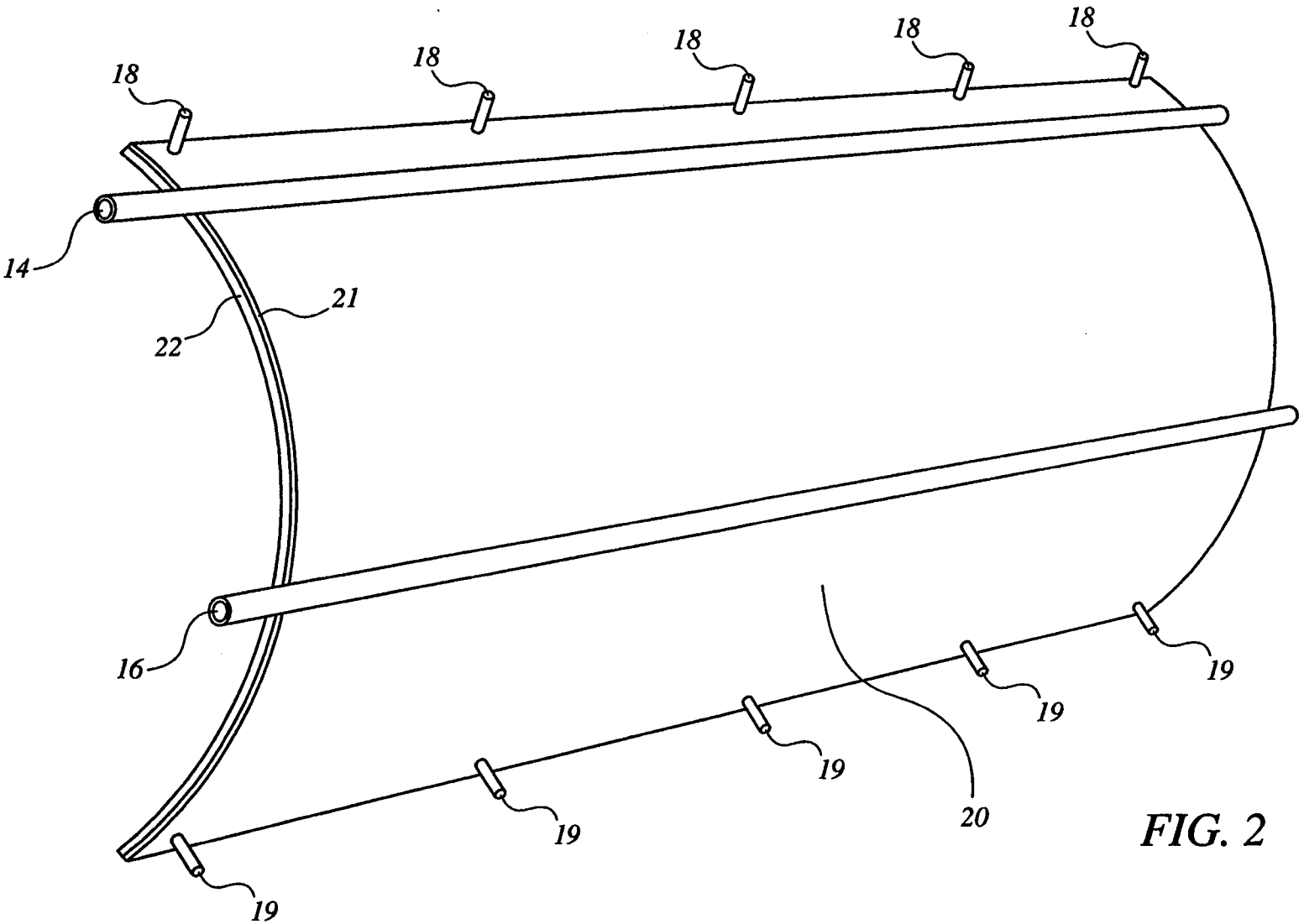
FIG. 2 is an isometric exterior view of a semi-rigid sweeper cover in accordance with the present invention.
Figure 3:
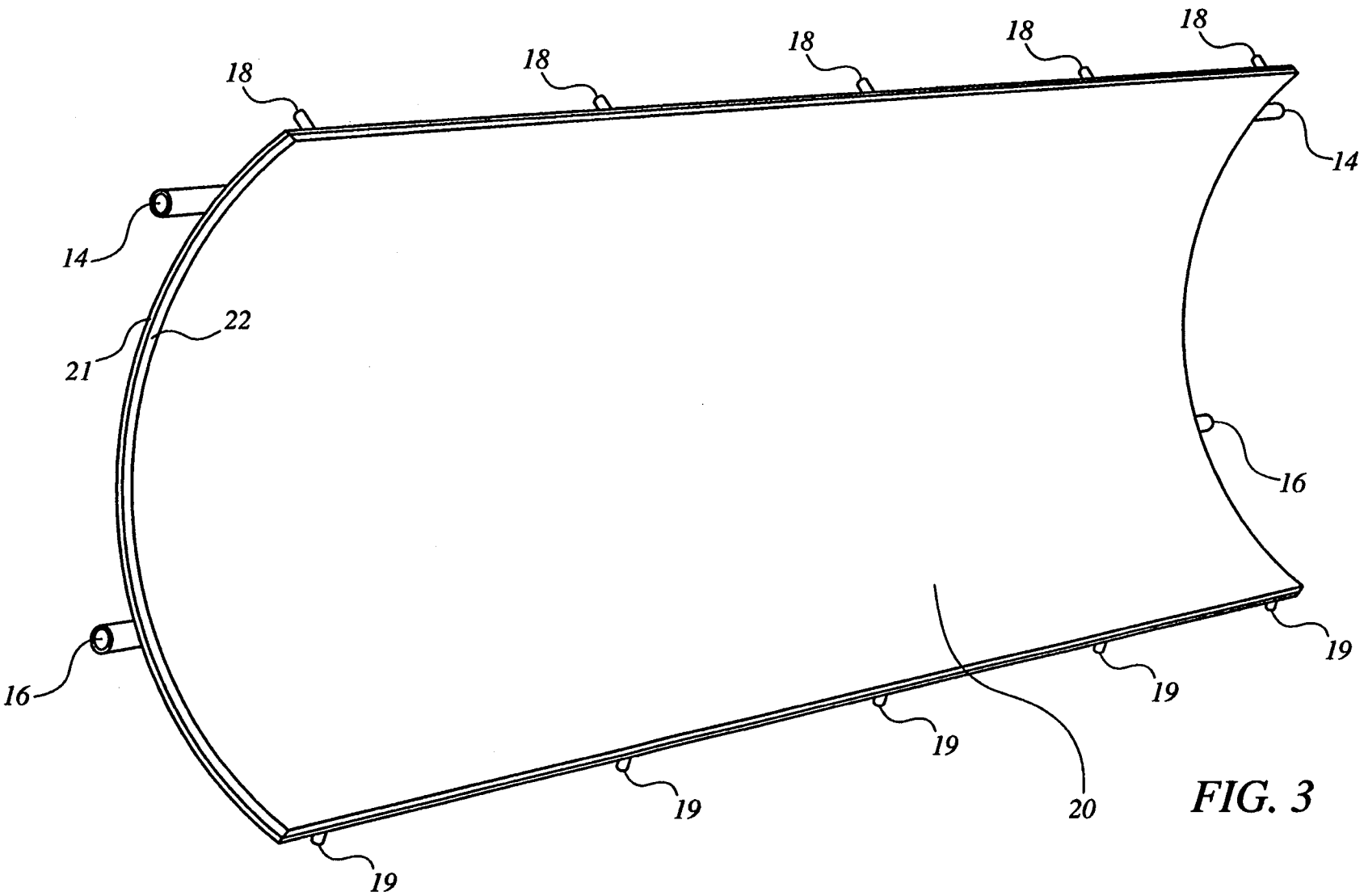
FIG. 3 is an isometric interior view of the semi-rigid sweeper cover shown in FIG. 2.
Figure 4:
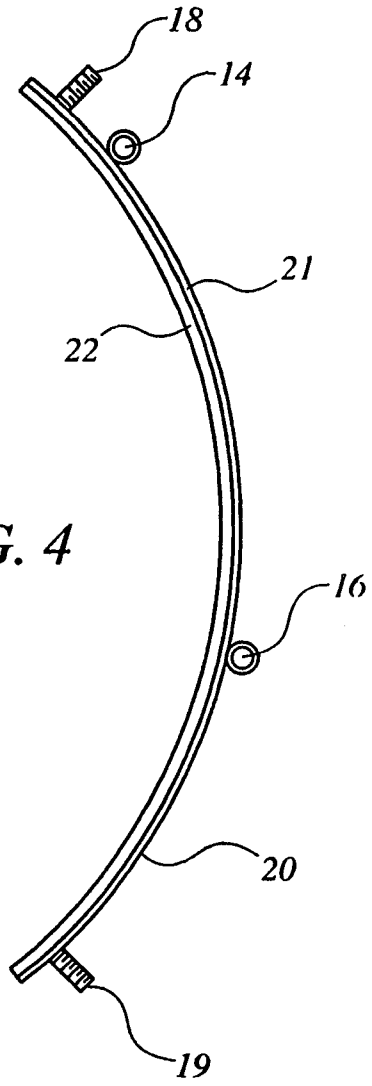
FIG. 4 is a side view of the semi-rigid sweeper cover shown in FIG. 2.

FIGS. 2, 3 and 4 detail a preferred embodiment of the invention designated as semi-rigid sweeper cover 20. Sweeper cover 20 has an exterior cover 21 comprised of a metal such as steel, a steel alloy or aluminum. An interior cover 22 is designed to conform to shape of a cylindrical rotary sweeper brush and is comprised of a polymer which may be selected from the group consisting of rubber, ultra-high molecular weight polyethylene, polypropylene, polyurethane, nylon or acrylics with embedded fibers is attached to exterior cover 21. Interior cover 22 is preferably ⅛ to ¼ inch thick, although other thicknesses may be employed. The attachment of interior cover 22 to exterior cover 21 can be accomplished by means of an adhesive, mechanical fasteners or a combination of both. Alternatively, the interior cover 22 can be applied and simultaneously attached to exterior cover 21 by means of a spray application.

The hardness of interior cover 22 is in the preferable range of 50° A to 70° D. Further degrees of hardness may be used, although the structural integrity of the metal cover provides additional support and protection such that additional hardness is not necessary.

In fabricating interior cover 22 the desired cover size can be cut from rubber and polyurethane sheets of the desired thickness. With ultra-high molecular weight polyethylene, polypropylene and nylon, on the other hand, the materials must first be preshaped by thermoforming at approximately 250° F. After these materials are preshaped, they may be attached by any of the methods described above. For acrylic with fiber impregnation, the material should be mixed and spread, in liquid form, on exterior cover 21, in the shape desired so that it will set-up and harden in this desired shape. The material would then be preferably bonded with adhesive, and additional bonding with mechanical fasteners could be provided if desirable.

Metal tubes 14 and 16 are attached to the exterior of exterior cover 21, with tube 14 located near the upper end of exterior cover 21 and tube 16 located at the middle portion of exterior cover 21. The ends of tubes 14 and 16 extend beyond the length of exterior cover 21.

Metal upper bolts 18 and lower bolts 19 are also attached to exterior cover 21. Such attachment can be made directly to exterior cover 21. Alternatively, upper bolts 18 and lower bolt 19 additionally can be used to mechanically attach interior cover 22 to exterior cover 21. In the event that upper bolts 18 and lower bolts 19 are used to accomplish such attachment, the ends of upper bolts 18 and lower bolts 19 must be of sufficient length to extend upward beyond the surface of exterior cover 21 and provide a means of further attachment.

In operation, interior cover 22 absorbs the direct corrosive 5 and fictional forces created by the operation of a mechanical street sweeper and the rotary movement of a sweeper brush. The polymer composition of interior cover 22 protects exterior cover 21 from such forces and greatly extends the useful life of sweeper cover 20.

Figure 6:
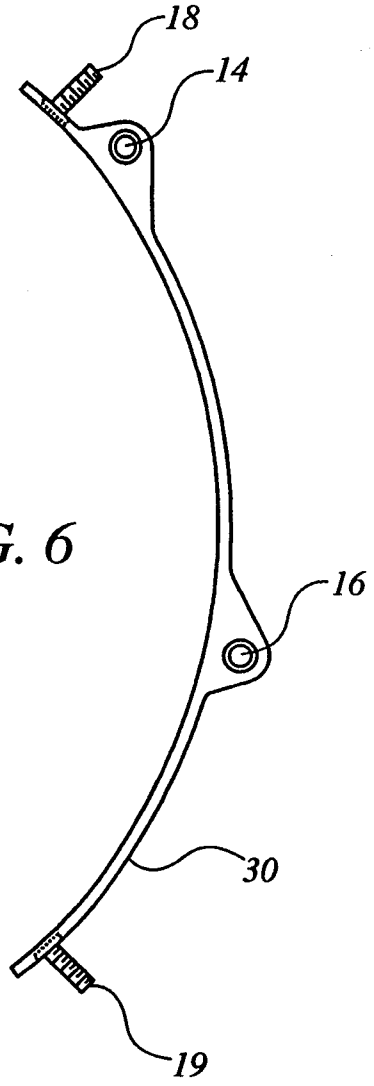
FIG. 6 is a side view of the semi-rigid sweeper cover shown in FIG. 5.
Figure 5:
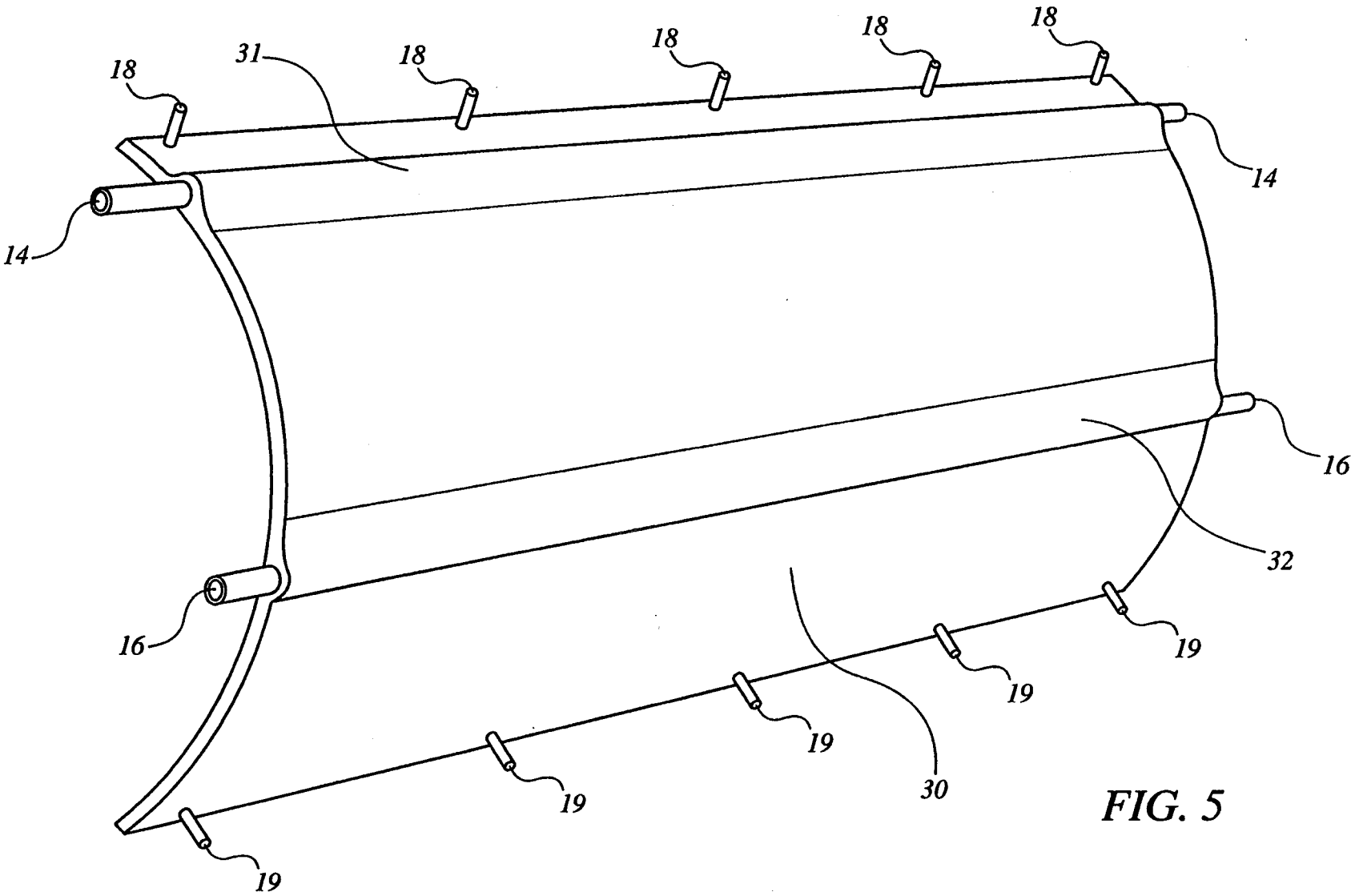
FIG. 5 is an isometric exterior view of a further embodiment of the semi-rigid sweeper cover in accordance with the present invention.

FIGS. 5 and 6 detail a further embodiment of the present invention. More specifically, FIGS. 5 and 6 depict sweeper cover 30 which also conforms to the shape of a cylindrical rotary sweeper brush and is comprised of the same polymers described above The preferred hardness of such polymers ranges from 90° A to 70° D, although other degrees of hardness again can be used. Additional hardness is required for this embodiment because the cover is without support from a metal backing. Sweeper cover 30 is preferably ¼ inches thick. It is possible to use other thicknesses, however, although a smaller thickness would reduce the useful life of the polymeric cover.

Metal inserts including tubes 14 and 16, upper bolts 18 and lower bolts 19 are embedded into sweeper cover 30. In particular, sweeper cover 30 shows tubes 14 and 16 located within polymeric ridges 31 and 32, which rise outward from the exterior of sweeper cover 30. Ridges 31 and 32 are formed during the fabrication of sweeper cover 30, at which time tubes 14 and 16 are placed in their desired positions. Upper bolts 18 and lower bolts 19 are similarly positioned during fabrication of sweeper cover 30.

The specific means of fabrication and the means of installing the metal inserts again depend upon the particular polymer utilized. More specifically, sweeper cover 30 is fabricated by means of open casting or compression molding, with the metal inserts in place, where rubber or polyurethane is used. For ultra-high molecular weight polyethylene, polypropylene or nylon, sweeper cover 30 must first be preshaped by thermoforming or extruding at approximately 250° F. A secondary operation of installing the metal tube and bolt inserts by thermo-welding polymer around the inserts is then required. Alternatively, ultra-high molecular weight polyethylene, polypropylene or nylon covers can be formed through use of compression or injection molding, with the metal inserts located during this process. Finally, if acrylic with fiber impregnation is used to form sweeper cover 30, such material again would be mixed and allowed to set-up and harden on a cover pattern with the metal inserts in place.

Figure 8:
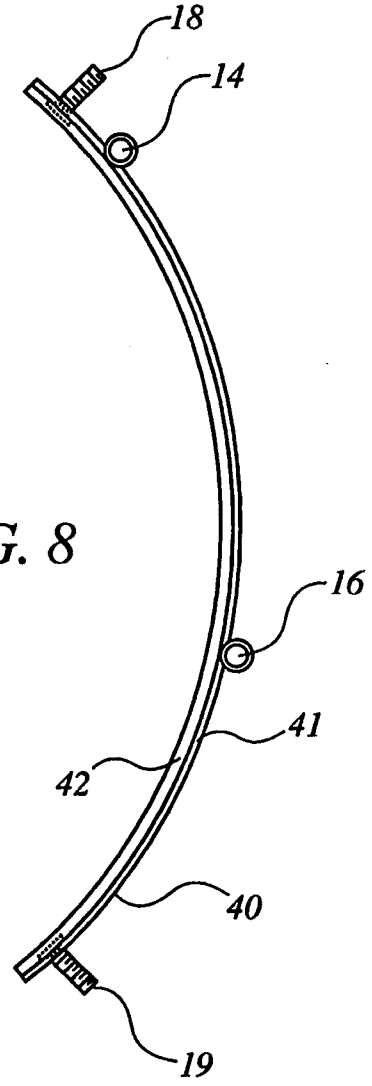
FIG. 8 is a side view of the semi-rigid sweeper cover shown in FIG. 7.
Figure 7:
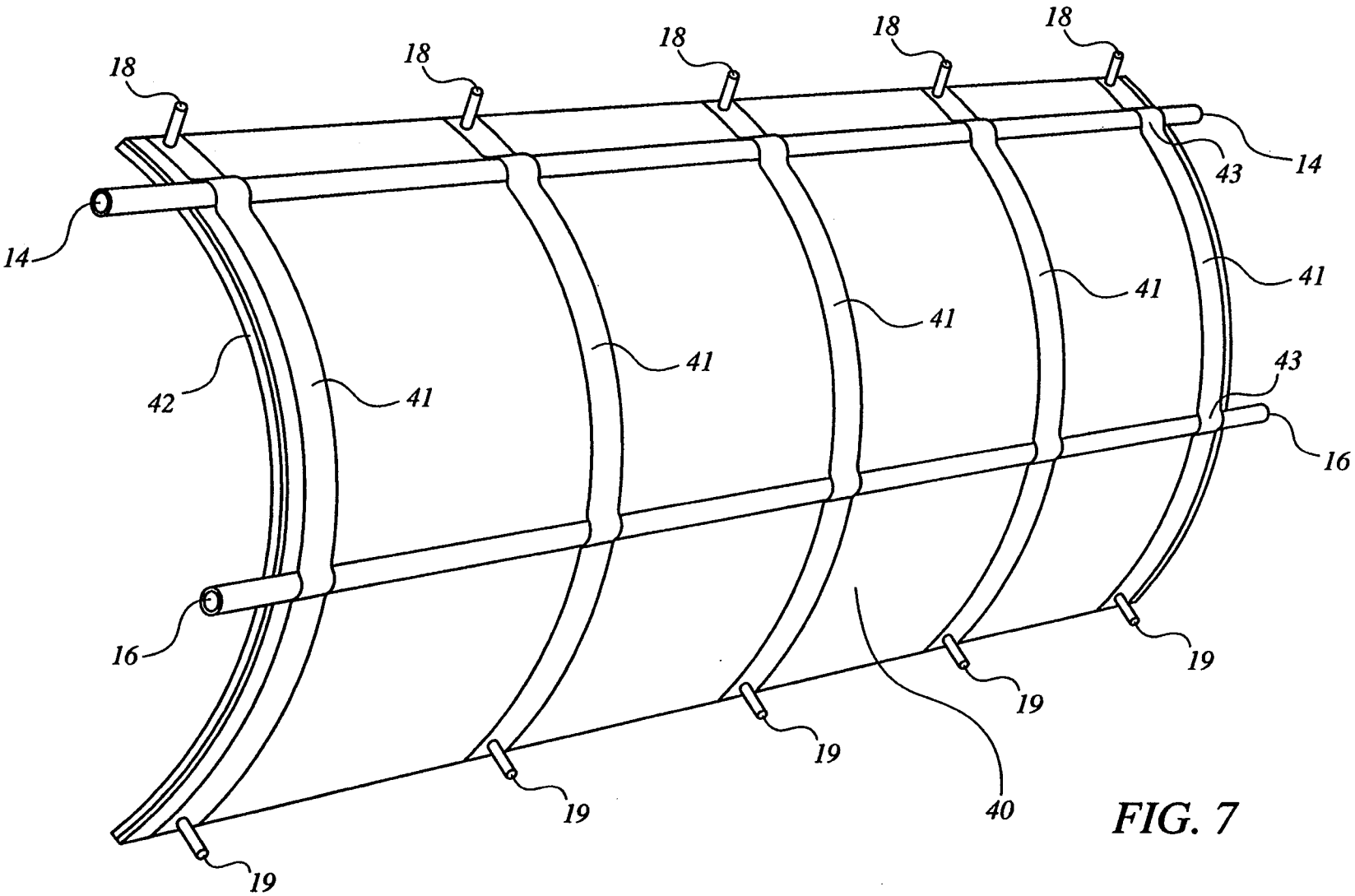
FIG. 7 is an isometric exterior view of a further embodiment in accordance with the present invention.

FIGS. 7 and 8 detail sweeper cover 40, a further embodiment of the present invention. Semi-rigid sweeper cover 40 is comprised of a concave polymeric cover 42, designed to conform to the shape of a cylindrical rotary sweeper brush, which cover 42 has exterior ribs 41 attached to it. The preferable hardness of cover 40 ranges from 90° A to 70° D, although further ranges, again, are possible. The preferable and possible thicknesses of cover 40 is similar to that of sweeper cover 30 depicted in FIGS. 5 and 6.

Exterior ribs 41 can be comprised of a metal or polymer and are attached to cover 40 by mechanical or adhesive means or a combination of both. The same polymers described above in connection with the two previous embodiments of the invention may be selected for use in connection with both the shield or ribs. FIG. 7 depicts five (5) ribs 41. Different numbers of ribs are possible, although at least two ribs 41 should be used. Ribs 41 provide further support and protection to polymeric Cover 42.

Fabrication of this embodiment of the invention, with respect to use of any of the above-described polymers, would be similar to the fabrication described in connection with sweeper cover 30.

Metal tubes 14 and 16 are attached directly to ribs 41. If ribs 41 are comprised of polymer, such attachment may occur by embedding tubes 14 and 16 within ribs 41 during fabrication. Alternatively, tubes 14 and 16 may be attached to ribs 41 by thermo-welding polymer around tubes 14 and 16. Metal upper bolts 18 and lower bolts 19 can be similarly attached during fabrication or by thermo-welding if ribs 41 are comprised of a polymer. Alternatively, upper bolts 18 and lower bolts 19 can be used to mechanically attach ribs 41 to polymeric cover 42, provided sufficient length is provided to allow upper bolts 18 and lower bolts 19 to extend upward from the exterior of ribs 41 and provide a means for further attachment. FIGS. 7 and 8 depict such mechanical attachment, with upper bolts 18 and lower bolts 19 embedded within cover 42. As a further alternative, such bolts also can pass entirely through cover 42, with the respective bolts heads resting against the inner surface of cover 42.

If ribs 41 are comprised of metal, as is depicted in FIGS. 7 and 8, tubes 14 and 16 and upper bolts 18 and lower bolts 19 can be attached to ribs 41 by means of soldering. Alternatively, tubes 14 and 16 can be attached to ribs 41 through use of metal clamps 43 which, in turn, are attached to ribs 41.

What is claimed is:

1. A polymeric cover for a rotary sweeper brush to cooperate with said sweeper brush lift and guide materials to a storage area, said cover having an inner surface which conforms to the shape of said sweeper brush when in motion; and said polymer selected from the group of materials having a shore hardness in the range of 50° A to 70° D and consisting of rubber, ultra-high molecular weight polyethylene, polypropylene, polyurethane, nylon and acrylic with embedded fibers.

2. The polymeric cover as set forth in claim 1 wherein said cover is attached to and serves as an interior liner for an exterior metal cover having the same shape as the polymeric cover.

3. The polymeric cover as set forth in claim 2 wherein said polymer is attached to said metal cover by an adhesive means.

4. The polymeric cover as set forth in claim 2 wherein said polymer is attached to said metal cover by a mechanical means.

5. The polymeric cover as set forth in claim 2 wherein said polymeric cover is applied and simultaneously attached to said metal cover by a spray means.

6. The polymeric cover as set forth in claim 1 wherein the polymers selected from the group consisting of rubber and polyurethane are fabricated and shaped by open casting or compression molding.

7. The polymeric cover as set forth in claim 1 wherein the polymers selected from the group consisting of ultra-high molecular weight polyethylene, polypropylene and nylon are shaped by thermoforming or extruding.

8. The polymeric cover as set forth in claim 1 wherein the polymers selected from the group consisting of ultra-high molecular weight polyethylene, polypropylene and nylon are fabricated and shaped by compression or injection molding.

9. The polymeric cover as set forth in claim 1 wherein said acrylic with fiber impregnation is formed by applying said acrylic with fiber impregnation mixture, in liquid form, onto a cover pattern and allowing said mixture to set-up and harden in a desired shape.

10. The polymeric cover as set forth in claim 1 wherein said polymeric cover comprises an arc-sectional length of a hollow cylinder having a length equal to or greater than the length of the sweeper brush and having an inner radius equal to or greater than the outer radius of the cylinder formed by a cylindrical rotary sweeper brush when in motion.

11. The polymeric cover as set forth in claim 1 wherein said polymeric cover further comprises metal tubing and stud bolts embedded into said polymeric cover, said tubing and stud bolts effective for use in installing said polymeric cover over said sweeper brush.

12. The polymeric cover as set forth in claim 11 wherein said wherein said metal tubing and stud bolts are inserted during fabrication and formation of the polymeric cover.

13. The polymeric cover as set forth in claim 11 wherein said metal tubing and stud bolts are installed onto said polymeric cover by thermo-welding a polymer around said tubing and stud bolts after fabrication of the polymeric cover.

14. The polymeric cover as set forth in claim 1 wherein said polymeric cover further comprises at least two external ribs and metal tubing and stud bolts mechanically attached to said ribs, said tubing and stud bolts effective for use in installing said polymeric cover over said sweeper brush.

15. The polymeric cover as set forth in claim 14 wherein said ribs are comprised of a polymer selected from the group consisting of rubber, ultra-high molecular weight polyethylene, polypropylene, polyurethane, nylon and acrylic with embedded fibers.

16. The polymeric cover as set forth in claim 14 wherein said ribs are metal.

17. The polymeric cover as set forth in claim 15 wherein said ribs are attached to said polymeric cover by thermo-welding.

18. The polymeric cover as set forth in claims 15 or 16 wherein said ribs are attached to said polymer by a mechanical means.

* * * * *